US005285913A

United States Patent [19]

Morton

[11] Patent Number: 5,285,913

[45] Date of Patent: Feb. 15, 1994

[54] CLOSURE ASSEMBLY WITH INSERT LINER

[75] Inventor: Hugh V. Morton, Veedersburg, Ind.

[73] Assignee: H-C Industries, Inc., Crawfordsville, Ind.

[21] Appl. No.: 981,010

[22] Filed: Nov. 24, 1992

[51] Int. Cl.[5] ..... B65D 53/00

[52] U.S. Cl. ..... 215/349; 215/350; 215/351

[58] Field of Search ..... 215/346, 347, 348, 349, 215/350, 351

[56] References Cited

U.S. PATENT DOCUMENTS

| | | | |
|---|---|---|---|
| 2,068,389 | 1/1937 | Smith | 215/350 |
| 2,130,749 | 9/1931 | Von Till . | |
| 3,433,380 | 10/1967 | Kawchitch . | |
| 3,480,170 | 11/1969 | Evans . | |
| 4,462,502 | 7/1984 | Luenser et al. . | |
| 4,497,765 | 2/1985 | Wilde et al. . | |
| 4,629,083 | 12/1986 | Druitt | 215/329 |
| 4,658,976 | 4/1987 | Pohlenz . | |
| 4,721,221 | 1/1988 | Barriac | 215/350 |

FOREIGN PATENT DOCUMENTS

| | | |
|---|---|---|
| 952962 | of 1964 | United Kingdom . |
| 975739 | of 1964 | United Kingdom . |

*Primary Examiner*—Stephen P. Garbe
*Assistant Examiner*—Nova Stucker
*Attorney, Agent, or Firm*—Dressler, Goldsmith, Shore, Sutker, & Milnamow, Ltd.

[57] ABSTRACT

A closure-assembly includes a molded plastic closure cap, and a disc-shaped insert liner positionable adjacent a top wall portion of the closure cap. An annular shoulder of the closure cap cooperates with the insert liner to form a top/side seal with an associated container. The annular shoulder includes at least one annular liner-engaging rib, which cooperates with the insert liner to enhance sealing performance of the closure assembly, retain the liner in position with the closure cap, and facilitate high-speed closure formation.

8 Claims, 1 Drawing Sheet

CLOSURE ASSEMBLY WITH INSERT LINER

TECHNICAL FIELD

The present invention relates generally to closures for containers, and more particularly to a closure assembly including an outer plastic closure cap, and a disc-shaped sealing insert liner positionable in the closure cap, with the cap including an arrangement for enhancing closure sealing, liner retention, and efficient manufacture.

BACKGROUND OF THE INVENTION

Various constructions are known for molded plastic closures for use with bottles and like containers. While one-piece constructions are known, optimum sealing is ordinarily achieved through the use of two-component or composite constructions, including an outer, relatively hard closure cap or shell, and an inner, relatively soft and pliable sealing liner. For example, U.S. Pat. No. 4,378,893, to Wilde et al., U.S. Pat. No. 4,407,442, to Wilde et al., and U.S. Pat. No. 4,497,765, to Wilde et al., hereby incorporated by reference, illustrate a composite closure construction including an outer closure cap, and a sealing liner formed in situ within said closure cap, wherein the sealing liner forms a top/side seal with an associated container (i.e., the closure includes both generally downwardly facing and generally inwardly facing sealing surfaces).

U.S. Pat. No. 4,658,976, to Pohlenz, hereby incorporated by reference, illustrates another form of closure including a relatively pliable sealing liner, with this closure including a so-called insert liner. In this construction, a preformed, disc-shaped liner is inserted into a molded closure shell, with the liner being urged into sealing engagement with an associated container when the closure assembly is placed thereon. Notably, the closure of this patent includes an annular shoulder at the juncture of the top wall and skirt portions of the closure cap, which shoulder cooperates with the sealing liner to form a top/side seal with an associated container.

While closures including an insert liner can be desirably economically manufactured, previous constructions have nevertheless suffered from certain design deficiencies. Because the inwardly facing side seal of this type of closure is formed generally along the vertical extent of the annular shoulder at the juncture of the top wall and skirt portions, the sealing contact with a container is not always sufficiently localized and concentrated for optimum sealing in all applications. Additionally, the relative cross-sectional mass of this annular shoulder can detract from efficient closure formation, since this mass of plastic material is relatively slow to cool during molding. Heretofore, closures of this type having insert liners have not been configured to abate undesired inadvertent dislodgement of the liner attendant to removal of the closure from a container. Dislodgement can occur because the diameter of the disc, after removal from a container, is sometimes significantly less than the diameter of the disc when it is initially inserted. Naturally, dislodgement of the liner can impair the sealing integrity of the closure.

The present invention is directed to a closure assembly, including a sealing insert liner, which is configured to provide enhanced sealing performance and improved liner retention, and which promotes high-speed manufacture.

SUMMARY OF THE INVENTION

A closure assembly embodying the principles of the .present invention includes a molded closure cap having a circular top wall portion, and an annular skirt portion depending from the top wall portion. The assembly further includes a disc-shaped, sealing insert liner positionable adjacent the top wall portion of the closure cap by insertion into the cap. Notably, the closure cap is configured to define a preferably annular, liner-engaging projection which desirably acts to concentrate compressive forces between the liner and the cap for enhanced sealing performance, and which acts to retain the liner in position within the cap while also facilitating high-speed manufacture.

In accordance with the illustrated embodiment, the closure cap includes an annular shoulder at the juncture of the top wall portion of the cap, and the skirt portion. The annular shoulder cooperates with the disc-shaped sealing insert liner to form a top/side seal with the associated container. In other words, the liner cooperates with the closure cap so that the liner is shaped to provide a downwardly facing sealing surface, as well as a generally inwardly facing sealing surface for sealingly engaging the associated container.

In accordance with the present invention, the annular shoulder includes an arrangement for promoting sealing, and which desirably acts to retain the sealing liner in position within the closure cap. The arrangement preferably comprises at least one annular, liner-engaging rib-like projection extending inwardly of the annular shoulder for engagement with the sealing liner. By this construction, an annular recess is defined by the annular shoulder for receiving and retaining the insert liner.

This configuration of the annular shoulder, including the provision of an annular liner-engaging rib, desirably acts to concentrate the compressive forces between the annular shoulder and the sealing liner. As a consequence, enhanced sealing performance is obtained.

Versatile application of the present closure assembly is achieved by the optional provision of an arrangement for controlling relative rotation between the closure cap and the sealing insert liner. Specifically, gripping knurling (or gripping projections) is provided generally within the annular recess on the inwardly facing surface of the annular shoulder, between the top wall portion and the retaining rib. This gripping arrangement can be selectively configured to provide the desired degree of resistance to relative rotation between the sealing liner and the closure cap. Versatile application of the present closure assembly is thus promoted.

Significantly, the configuration of the annular shoulder, including at least one annular liner-engaging rib, promotes high-speed manufacture of the closure cap, in that high-speed removal from associated mold tooling is facilitated.

Other features and advantages of the present closure will become readily apparent from the following detailed description, the accompanying drawings, and the appended claims.

DETAILED DESCRIPTION

Figure 1:
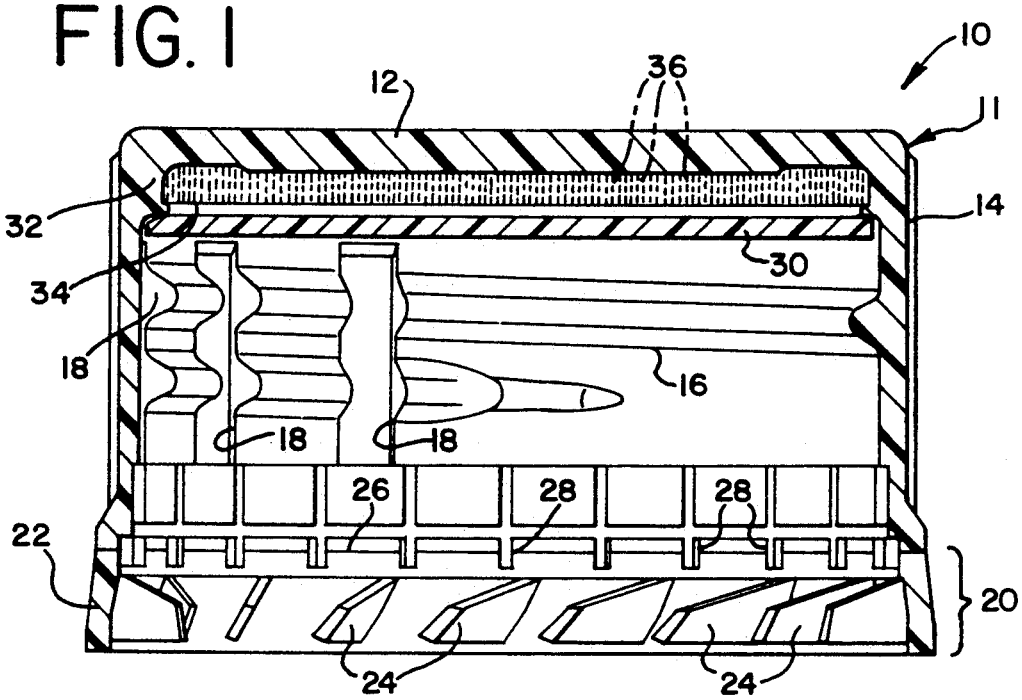
FIG. 1 is a cross-sectional view of a closure assembly embodying the principles of the present invention.

While the present invention is susceptible of embodiment in various forms, there is shown in the drawings and will hereinafter be described a presently preferred embodiment, with the understanding that the present disclosure is to be considered as an exemplification of the invention, and is not intended to limit the invention to the specific embodiment illustrated.

With reference now to the drawings, therein is illustrated a closure assembly 10 embodying the principles of the present invention. As will be further described, closure assembly 10 includes a so-called insert liner, that is, a preformed liner which is inserted into a molded, outer closure cap 11 prior to application of the assembly on an associated container.

The closure cap 11 can be efficiently and economically molded from plastic material, such as by compression or injection molding of polypropylene. Efficient manufacture by compression molding can be effected in accordance with the teachings of U.S. Pat. No. 4,497,765, hereby incorporated by reference. Other plastic materials, and molding techniques, can alternately be employed.

Figure 2:
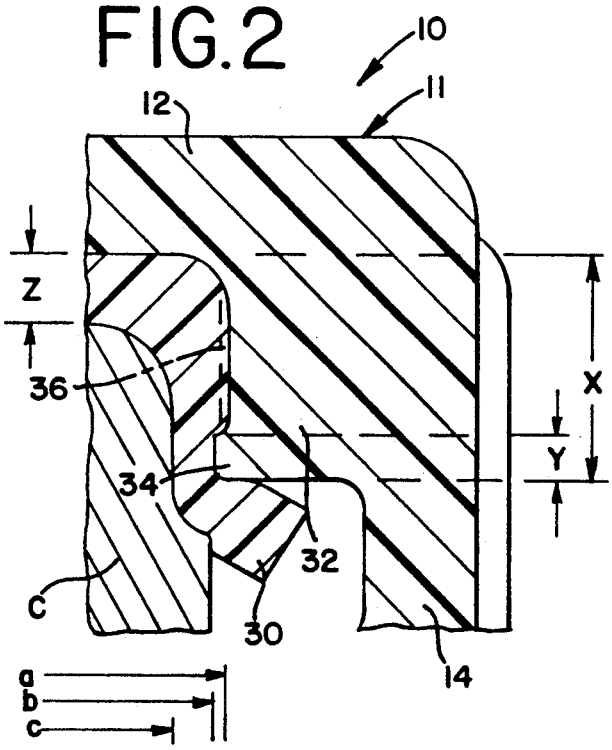
FIG. 2 is a fragmentary, cross-sectional view illustrating the present closure assembly applied to an associated container.

Closure cap 11 includes a circular top wall portion 12., and an annular skirt portion 14 depending integrally from the top wall portion 12. The skirt portion 14 includes an internal, single helical thread formation 16, configured for threaded engagement with a like thread formation on an associated container (designated C in FIGS. 2 and 3).

In order to facilitate use of the present closure on a container having carbonated or otherwise pressurized contents, the skirt portion of the closure defines a plurality of axially extending vent grooves 18 which facilitate venting of gas pressure from within the associated container during closure removal.

It is ordinarily desirable to configure a closure such as illustrated for tamper-evident use, and to this end, the closure cap 11 includes an annular pilfer band 20 depending from skirt portion 14. Pilfer band 20 is illustrated as being configured in accordance with the teachings of U.S. Pat. No. 4,418,828, hereby incorporated by reference, but may alternately be otherwise configured, such as in accordance with the teachings of U.S. Pat. No. 4,938,370, or U.S. Pat. No. 5,004,112, both of which are hereby incorporated by reference.

As illustrated, pilfer band 20 includes an annular band portion 22, inwardly from which extend a plurality of circumferentially spaced, relatively flexible container-engaging projections 24. The pilfer band 20 and the skirt portion 14 are separated and distinguished from each other by a circumferentially extending scoreline 26, with the scoreline 26 extending partially into a plurality of circumferentially spaced frangible ribs 28. The unscored, residual portions of the frangible ribs 28 provide the desired frangible connection between the pilfer band and the skirt portion.

In accordance with the present invention, closure assembly 10 includes a disc-shaped, sealing insert liner 30. As illustrated in FIG. 1, subsequent to insertion of the liner 30 into the closure cap 11, but prior to application of the closure assembly to a container, the insert liner 30 is generally flat. Insert liners of this type can be very efficiently formed, such as by die-cutting or the like of sheet plastic material (such as poly vinyl acetate), with the disc-shaped liner thereafter inserted into position within the associated closure cap.

Although the insert liner 30 is generally flat after insertion into the closure cap 11, the closure cap is configured to cooperate with the disc-shaped liner, attendant to application to a container, for deforming and shaping the liner to form a top/side seal with the associated container. To this end, the closure cap includes an annular shoulder 32 at the juncture of the top wall portion 14 and skirt portion 16. The annular shoulder 32, which includes an annular, generally inwardly facing surface, and an annular, generally downwardly facing surface.

The shoulder 32 cooperates with the insert liner 30, attendant to application to a container, so that the liner is shaped to provide a generally downwardly facing sealing surface (for forming a top seal with the container), and a generally inwardly facing sealing surface (for forming a side seal with the container). Such a top/side seal can be particularly effective when the closure assembly is used on a container having carbonated or otherwise pressurized contents. In such an application, the top wall portion 12 of the container can tend to dome or bow upwardly under the influence of the pressurized contents. Although this upward doming can sometimes reduce the top sealing of the liner 30 with the associated container, the annular shoulder 32 is urged inwardly, thus enhancing the side seal engagement between the liner 30 and the container. As will be recognized by those familiar with the art, the insert liner 30 can be subjected to plastic deformation attendant to application of the assembly to the associated container.

In accordance with the present invention, the annular shoulder 32 includes at least one liner-engaging projection, preferably in the form of a continuous and uninterrupted, annular liner-engaging rib 34 which cooperates with the insert liner 30. By this configuration, a preferably continuous annular recess is defined by the inwardly facing surface of the annular shoulder 32.

Attendant to application of the present closure to a container, the disc-shaped liner 30 is deformed and urged against top wall portion 12, with the liner received within the annular recess defined by rib 34, at the inside surface of the annular shoulder 32. This arrangement desirably acts to retain the liner within the closure. As will be appreciated, however, the disc-shaped liner can exhibit a tendency to return to its original disc-shape (after removal of the closure from the associated container), with the liner thus exhibiting some tendency to "pull out" of the annular recess within which it is retained. Experience has shown this tendency of the liner to return to its original disc-shape is more pronounced in those constructions wherein the diameter of the liner is relatively large compared to the inside diameter of the annular shoulder 32. It is thus believed that liner retention is enhanced by minimizing the diameter of the liner, while still assuring retention of the liner within the cap prior to application (i.e., prior to deformation of the liner), and while still assuring the desired sealing contact with the associated container.

The provision of at least one liner-engaging rib 34 provides several additional distinct advantages for the present closure assembly. In contrast with previous constructions, the provision of the annular rib 34 acts to concentrate and localize compressive forces between the annular shoulder 32 and the insert liner 30. This is believed to enhance sealing engagement with the associated container since side sealing forces between the liner and the container are concentrated generally in the region of the retaining rib (i.e., higher unit sealing pressure). This is in distinction from previous constructions, wherein sealing forces are formed generally along the vertical extent of such an annular shoulder.

Additionally, the present construction can be configured such that the concentration of compressive forces can create stresses between the retaining rib 34 and the liner material which are sufficient to exceed the yield stress of the liner material. As a consequence, permanent deformation of the insert liner in the region of the retaining lip results. At the same time, unyielded material in the adjacent recess exerts a radial outward force, holding the liner firmly in place. By this arrangement, the liner is resistant to accidental fall-out or inadvertent removal from the closure.

The present closure assembly can be optionally configured to include an arrangement for controlling relative rotation between the insert liner 30 and the closure cap 11. Such control of relative rotation can be effected by providing an arrangement on the inwardly facing surface of the annular shoulder 32 for gripping the insert liner 30. This can be provided in the form of gripping knurling or other projections (shown in phantom line at 36).

Such knurling or projections can be "straight", i.e., configured to create similar resistance in both directions of relative rotation of the closure cap and liner. Alternately, the projections can be configured to provide a ratchet-like action (that is, create greater resistance to relative rotation in one direction versus the other), such as by configuring the projections to each include a ramping or camming surface, and an adjacent, generally radial gripping surface.

The optional provision of gripping knurling 36 enhances the versatility of the present closure assembly. For some applications, it is desired to accommodate relative rotation between the closure cap and the liner, and thus little or no gripping knurling may be desired. For example, when used on returnable glass containers, which may exhibit defects or damage in their finish, it can be desirable to permit some relative rotation between the liner and the closure cap, thus permitting the liner to sealingly engage the container finish (including any defects therein) without cutting or otherwise damaging the insert liner. For some applications, it can be desirable to abate and minimize any relative rotation between the insert liner and the closure cap, and thus the gripping knurling can be employed for such applications. For example, it can sometimes be desirable for closures including plural thread formations to require additional torque for closure application and removal (by limiting relative rotation between the liner and cap), which desirably acts to abate the tendency of such closure to loosen from the associated container.

A particularly desirable benefit of the recess or undercut which is created by the provision of the annular rib 34 relates to high-speed closure manufacture. In particular, closures can be most efficiently manufactured when they are "stripped" or "popped off", of an associated male molding plunger or tool, without relatively rotating or "unthreading" each closure from its respective forming plunger. Such stripping is ordinarily effected by removing the molded closure from the associated female mold, while the closure is still on the male plunger, and thereafter relatively moving a stripper sleeve surrounding the plunger against the lower edge of the closure (such as pilfer band 20) for urging the closure from the plunger (see referenced U.S. Pat. No. 4,497,765).

Experience has shown that closure forming speeds are typically limited by the tendency of the closure thread formation to excessively permanently form attendant to such stripping. During such stripping, the closure skirt is deformed outwardly as the thread formation is urged from the grooves within which it is formed with a cam-like action, thus requiring that the thread formation exhibit a sufficient degree of ridigity, i.e., be sufficiently cooled, to avoid excessive deformation.

Notably, the provision of the annular rib 34, and the recess thus formed in the shoulder 32, act to assist with such mold ejection. Specifically, because the annular shoulder 32 (by virtue of the recess therein) tends to be retained on the free end of the male plunger during mold ejection, an outward deformation or bowing of the closure skirt portion or side wall is created as the closure is urged off the plunger by the stripper sleeve. This, in turn, acts to reduce the forces which must otherwise ordinarily be carried by the thread formation alone for outwardly deforming the side wall, and thus facilitating stripping of the closure from the male plunger.

This action of the annular rib 34, during ejection, can be appreciated by visualizing stripping of an unthreaded closure from an associated male plunger. During stripping, the retention provided by the annular rib 34 would act to create outward deformation or bowing of the closure side wall until release of the retaining rib from the male plunger. A similar outward deformation or bowing is created with a threaded closure, thus acting to reduce the load upon the closure thread formation during stripping. This cooperation of the annular rib with the male molding plunger is believed to facilitate higher forming speeds, by reducing the forces exerted on the thread formation during stripping.

Closure formation is further facilitated by the relative reduction in cross-sectional mass at the annular shoulder 32. By the provision of the annular recess defined at the inside surface of shoulder 32 by annular rib 34, the mass of plastic material at the shoulder, in comparison to previous constructions, can be reduced. Aside from the highly desirable saving in material, this reduction of mass facilitates cooling and solidification of the closure cap during molding, thus facilitating increased forming speeds.

Figure 3:
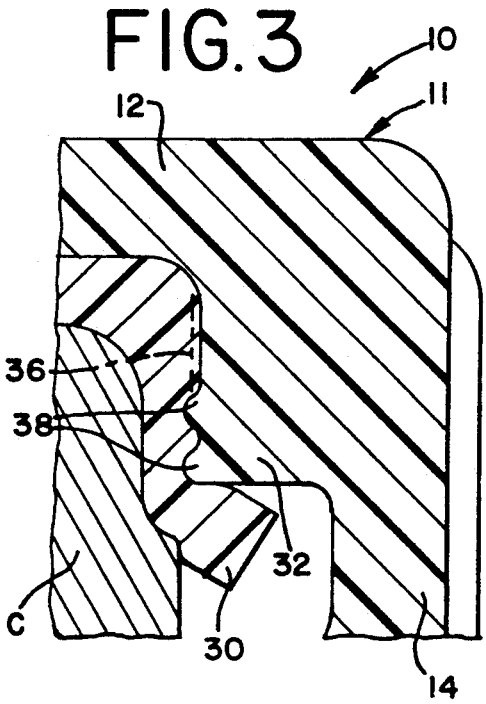
FIG. 3 is a view similar to FIG. 2 illustrating a modified embodiment of the present closure assembly.

A modified embodiment of the present closure assembly is illustrated in FIG. 3, wherein a pair of vertically spaced annular liner-engaging ribs 38 are provided on the annular shoulder 32. It is believed that this arrangement can be desirable for use on containers exhibiting defects (such as returnable glass containers), with the provision of a pair of the annular ribs further acting to retain the insert liner 30 within the closure cap during removal from an associated container.

In a current embodiment of the present closure, suited for use on containers having a conventional finish, a dimension "x" (FIG. 2), of 0.070 inches has been used for the vertical dimension of annular shoulder 32, with a dimension "y" of 0.020 inches employed for the dimension of the retaining lip 34. The thickness of the liner insert, after application to an associated container C, is on the order of 0.032 inches as shown at dimension "z".

Diameter "a", the inside diameter of the recess formed in the annular shoulder 32, is on the order of 1.024 inches, while the diameter to the inside edge of the annular shoulder, dimension "b" is on the order of 1.014 inches. Diameter "c" corresponds to the nominal outside diameter of an associated container finish, 0.951 inches. A disc-shaped sealing insert liner formed from ethyl vinyl acetate (EVA compound), with a nominal liner thickness of 0.040 inches has been used. Other liner compositions can be employed.

From the foregoing, it will be observed that numerous modifications and variations can be effected without departing from the true spirit and scope of the novel concept of the present invention. It is to be understood that no limitation with respect to the specific embodiment illustrated herein is intended or should be inferred. The disclosure is intended to cover, by the appended claims, all such modifications as fall within the scope of the claims.

What is claimed is:

1. A closure assembly for a container, comprising:

a closure cap having a circular top wall portion, and an annular skirt portion depending from said top wall portion, and a disc-shaped, sealing insert liner positionable adjacent said top wall portion by insertion into said closure cap for sealingly engaging said container, said sealing liner being formed prior to insertion in said closure cap, said closure cap including annular shoulder means at the juncture of said top wall portion and said skirt portion, said shoulder means cooperating with said disc-shaped sealing insert liner to provide said liner with a generally inwardly facing sealing surface for sealingly engaging said container, said closure including projection means for engaging said inset liner, said projection means comprising at least one annular rib extending inwardly of said annular shoulder means, said annular rib having an inside diameter for engagement with said insert liner, said liner being dimensioned for disposition of said liner between said annular rib and said container while said liner is held against said top wall portion of said closure cap, said annular rib extending parallel to and spaced from said top wall to define recess means at an inside surface of said annular shoulder means for receiving said insert liner upon application of the closure to said container.

2. A closure assembly in accordance with claim 1, including means for controlling relative rotation between said closure cap and said insert liner.

3. A closure assembly in accordance with claim 2, wherein said controlling means comprises means on an inwardly facing surface of said shoulder means for gripping said insert liner.

4. A closure assembly in accordance with claim 1, wherein said recess means comprises an annular recess at the inside surface of said annular shoulder means for receiving and retaining said insert liner.

5. A closure assembly in accordance with claim 4, including liner gripping means within said recess means for gripping said insert liner for controlling relative rotation between said insert liner and said closure cap.

6. A closure assembly for a container, comprising:

a closure cap having a circular top wall portion, and an annular skirt portion depending from said top wall portion, and having an internal thread formation, and a disc-shaped sealing insert liner positionable adjacent said top wall portion by insertion into said closure cap for sealingly engaging said container, said sealing liner being formed prior to insertion in said closure cap, said closure cap including annular shoulder means at the juncture of said top wall portion and said skirt portion, said shoulder means cooperating with said disc-shaped sealing insert liner to form a generally inwardly facing sealing surface on said liner, said shoulder means including means for concentrating compressive forces between said shoulder means and said insert liner comprising at least one annular rib extending inwardly of said shoulder means for engagement with said insert liner, said annular rib extending parallel to and spaced from said top wall portion and having an inside diameter engageable with said insert liner for concentrating said compressive forces at said inwardly facing sealing surface of said liner, said liner being dimensioned for disposition of said liner between said annular rib and said container while said liner is held against said top wall portion of said closure cap.

7. A closure assembly in accordance with claim 6, including liner gripping means on said shoulder means between said top wall portion and said annular rib for gripping said insert liner for controlling relative rotation of said insert liner and said closure cap.

8. A closure assembly for a container, comprising:

a closure cap having a circular top wall portion, and an annular skirt portion depending from said top wall portion, and a disc-shaped, sealing insert liner positionable adjacent said top wall portion by insertion into said closure cap for sealingly engaging said container, said closure cap including annular shoulder means at the junction of said top wall portion and said skirt portion, said shoulder means cooperating with said disc-shaped sealing insert line to provide said liner with a generally inwardly facing sealing surface for sealingly engaging said container, said closure including projection means for engaging said insert liner, said projection means comprising a pair of annular retaining ribs extending inwardly of said annular shoulder means for engagement with said insert liner.

* * * * *